US009715193B2

(12) United States Patent
Nakaegawa et al.

(10) Patent No.: US 9,715,193 B2
(45) Date of Patent: Jul. 25, 2017

(54) IMAGE FORMING APPARATUS WITH CONSTANT VOLTAGE ELEMENT FOR SECONDARY TRANSFER OF TONER IMAGE

(71) Applicant: CANON KABUSHIKI KAISHA, Tokyo (JP)

(72) Inventors: Tohru Nakaegawa, Nagareyama (JP); Masanori Shida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/986,972

(22) Filed: Jan. 4, 2016

(65) Prior Publication Data

US 2016/0116865 A1 Apr. 28, 2016

Related U.S. Application Data

(60) Division of application No. 14/505,736, filed on Oct. 3, 2014, now Pat. No. 9,256,166, which is a (Continued)

(30) Foreign Application Priority Data

Apr. 3, 2012 (JP) ..... 2012-084974

(51) Int. Cl.
*G03G 15/16* (2006.01)
*G03G 15/00* (2006.01)

(52) U.S. Cl.
CPC ..... *G03G 15/1605* (2013.01); *G03G 15/1675* (2013.01); *G03G 15/50* (2013.01); *G03G 15/5004* (2013.01)

(58) Field of Classification Search
CPC ..... G03G 15/1605; G03G 15/1675; G03G 15/5004; G03G 15/161
(Continued)

(56) References Cited

U.S. PATENT DOCUMENTS 6,294,305 B1 9/2001 Kobayashi et al.
6,421,521 B2 7/2002 Tanaka
(Continued)

FOREIGN PATENT DOCUMENTS

JP 2001-175092 6/2001
JP 2001-255761 9/2001
(Continued)

OTHER PUBLICATIONS

Notice of Allowance dated Apr. 21, 2017 in counterpart Russian Application No. 2016103763, with English translation.

*Primary Examiner* — Hoang Ngo
(74) *Attorney, Agent, or Firm* — Fitzpatrick, Cella, Harper & Scinto

(57) ABSTRACT

In a constitution in which a power source exclusively for primary-transfer is omitted and a predetermined voltage is generated in an intermediary transfer member, in a test mode in which a test voltage is applied to a secondary-transfer member in advance in order to obtain a proper secondary transfer voltage, in the case where the test voltage is low, a proper secondary-transfer voltage cannot be obtained in some cases. In a period of the test mode, the power source is controlled in order to maintain a Zener breakdown voltage, so that the proper secondary-transfer voltage can be obtained.

19 Claims, 7 Drawing Sheets

Related U.S. Application Data continuation of application No. PCT/JP2013/060762, filed on Apr. 3, 2013.

(58) Field of Classification Search
USPC ..... 399/66
See application file for complete search history.

(56) References Cited

U.S. PATENT DOCUMENTS

| | | | | |
|---|---|---|---|---|
| 6,618,565 | B2 | 9/2003 | Tamiya et al. | |
| 6,785,482 | B2 | 8/2004 | Ogata et al. | |
| 6,829,450 | B2 | 12/2004 | Tamiya et al. | |
| 8,060,003 | B2 | 11/2011 | Yoshizawa | 399/396 |
| 8,265,499 | B2 | 9/2012 | Sueoka | |
| 8,532,514 | B2 | 9/2013 | Shida | |
| 8,634,737 | B2 | 1/2014 | Nakaegawa | |
| 2001/0021316 | A1 | 9/2001 | Izawa et al. | |
| 2001/0031160 | A1* | 10/2001 | Tanaka | G03G 15/0131 399/299 |
| 2009/0080923 | A1 | 3/2009 | Murayama | |
| 2010/0021193 | A1 | 1/2010 | Kojima | |
| 2010/0209128 | A1 | 8/2010 | Sueoka | |
| 2013/0188980 | A1 | 7/2013 | Ito et al. | |
| 2015/0016833 | A1 | 1/2015 | Nakaegawa | |
| 2015/0093133 | A1 | 4/2015 | Nakaegawa et al. | |

FOREIGN PATENT DOCUMENTS

| | | |
|---|---|---|
| JP | 2001-265135 | 9/2001 |
| JP | 2001255761 A | 9/2001 |
| JP | 2003-035986 | 2/2003 |
| JP | 2003-280331 | 10/2003 |
| JP | 2004-117920 | 4/2004 |
| JP | 2006-259640 | 9/2006 |
| JP | 2010-191276 | 9/2010 |
| JP | 2011-039428 | 2/2011 |
| JP | 2012-098709 | 5/2012 |
| RU | 2367013 | 9/2009 |
| WO | 2012/046824 | 4/2012 |

* cited by examiner

IMAGE FORMING APPARATUS WITH CONSTANT VOLTAGE ELEMENT FOR SECONDARY TRANSFER OF TONER IMAGE

This application is a divisional of application Ser. No. 14/505,736 filed Oct. 3, 2014, which in turn is a continuation of PCT Application No. PCT/JP2013/060762 filed on Apr. 3, 2013, which claims benefit of Japanese Patent Application No. 2012-084974 filed Apr. 3, 2012.

TECHNICAL FIELD

The present invention relates to an image forming apparatus using an electrophotographic type, such as a copying machine, a printer or the like.

BACKGROUND ART

In an electrophotographic type image forming apparatus, in order to meet various recording materials, an intermediary transfer type is known, in which a toner image is transferred from a photosensitive member onto an intermediary transfer member (primary-transfer) and then is transferred from the intermediary transfer member onto the recording material (secondary-transfer) to form an image.

Japanese Laid-open Patent Application 2003-35986 discloses a conventional constitution of the intermediary transfer type. More particularly, in Japanese Laid-open Patent Application 2003-35986, in order to primary-transfer the toner image from the photosensitive member onto the intermediary transfer member, a primary-transfer roller is provided, and a power source exclusively for the primary-transfer is connected to the primary-transfer roller. Furthermore, in Japanese Laid-open Patent Application 2003-35986, in order to secondary-transfer the toner image from the intermediary transfer member onto the recording material, a secondary-transfer roller is provided, and a voltage source exclusively for the secondary-transfer is connected to the secondary-transfer roller.

In Japanese Laid-open Patent Application 2006-259640, there is a constitution in which a voltage source is connected to an inner secondary-transfer roller, and another voltage source is connected to the outer secondary-transfer roller. In Japanese Laid-open Patent Application 2006-259640, there is description to the effect that the primary-transfer of the toner image from the photosensitive member onto the intermediary transfer member is effected by voltage application to the inner secondary-transfer roller by the voltage source.

SUMMARY OF THE INVENTION

Problem to be Solved by Invention

However, when the voltage source exclusively for the primary-transfer is provided, there is a liability that it leads to an increase in cost, so that a method for omission of the voltage source exclusively for the primary-transfer is desired.

A constitution in which a voltage source exclusively for the primary-transfer is omitted, and the intermediary transfer member is grounded through a constant-voltage element to produce a predetermined primary-transfer voltage, has been found.

However, in the above constitution, there is a problem that in the case where a test voltage is low in a test mode in which the test voltage is applied to the secondary-transfer member in advance in order to obtain a proper secondary-transfer voltage, a potential of a roller opposing the secondary-transfer member is lowered thereby to increase an electric field at the secondary-transfer portion, and thus the proper secondary-transfer voltage cannot be obtained.

Means for Solving Problem

The present invention provides an image forming apparatus includes: an image bearing member for bearing a toner image; an intermediary transfer member for carrying the toner image transferred from the image bearing member at a primary-transfer position; a transfer member for transferring the toner image from the intermediary transfer member onto a recording material at a secondary-transfer position; a constant-voltage element, which is provided contactable with an outer peripheral surface of the intermediary transfer member and which is electrically connected between the intermediary transfer member and a ground potential, for maintaining a predetermined voltage by passing of a current therethrough; a power source for forming, by applying a voltage to the transfer member to pass the current through the constant-voltage element, both of a secondary-transfer electric field at the secondary-transfer position and a primary-transfer electric field at the primary-transfer position; a detecting portion for detecting the current passing through the transfer member; an executing portion for executing a test mode in which when no recording material exists at the secondary-transfer position, a test voltage is applied to the transfer member by the power source to detect the current by the detecting portion; and a controller for controlling, on the basis of the current detected by the detecting portion in the test mode, a voltage to be applied to the transfer member by the power source when the recording material exists at the secondary-transfer position, wherein the controller controls the test voltage applied by the power source so that the constant-voltage element maintains the predetermined voltage in a period of the test mode.

Effect of the Invention

In the constitution in which the predetermined voltage is generated in the intermediary transfer member by the constant-voltage source, it is possible to avoid a problem, such that the proper voltage cannot be obtained capable of generating in the case where a test mode in which a test voltage is applied.

EMBODIMENTS FOR CARRYING OUT INVENTION

Figure 1:
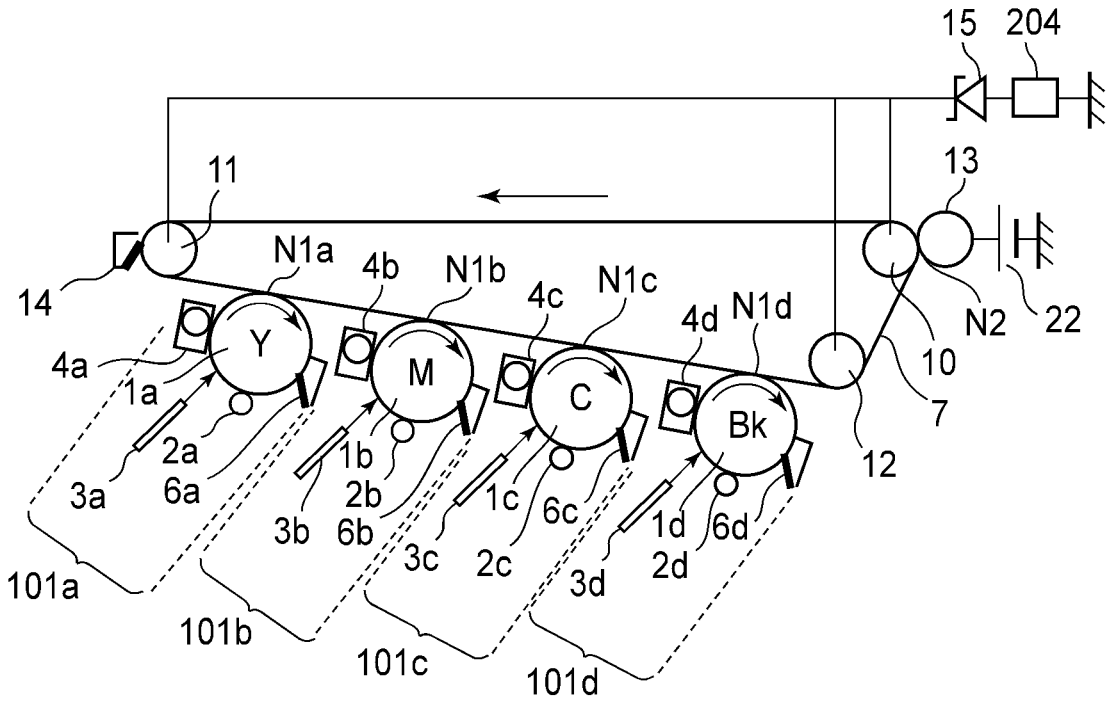
FIG. 1 is an illustration of a basic structure of an image forming apparatus.

In the following, embodiments of the present invention will be described along the drawings. Incidentally, in each of the drawings, the same reference numerals are assigned to elements having the same structures or functions, and the redundant description of these elements is omitted.

Embodiment 1

[Image Forming Apparatus]

FIG. 1 shows an image forming apparatus in this embodiment. The image forming apparatus employs a tandem type in which image forming units for respective colors are independent and arranged in tandem. In addition, the image forming apparatus employs an intermediary transfer type in which toner images are transferred from the image forming units for respective colors onto an intermediary transfer member, and then are transferred from the intermediary transfer member onto a recording material.

Image forming stations 101*a*, 101*b*, 101*c*, 101*d* are image forming means for forming yellow (Y), magenta (M), cyan (C) and black (K) toner images, respectively. These image forming units are disposed in the order of the image forming units 101*a*, 101*b*, 101*c* and 101*d*, that is, in the order of yellow, magenta, cyan and black, from an upstream side with respect to a movement direction of an intermediary transfer belt 7.

The image forming units 101*a*, 101*b*, 101*c*, 101*d* include photosensitive drums 1*a*, 1*b*, 1*c*, 1*d* as photosensitive members (image bearing members), respectively, on which the toner images are formed. Primary chargers 2*a*, 2*b*, 2*c*, 2*d* are charging means for charging surfaces of the respective photosensitive drums 1*a*, 1*b*, 1*c*, 1*d*. Exposure devices 3*a*, 3*b*, 3*c*, 3*sd* are provided with laser scanners to expose to light the photosensitive drums 1*a*, 1*b*, 1*c* and 1*d* charged by the primary chargers. By outputs of the laser scanners being rendered on and off on the basis of image information, electrostatic images corresponding to images are formed on the respective photosensitive drums. That is, the primary charger and the exposure means function as electrostatic image forming means for forming the electrostatic image on the photosensitive drum. Developing devices 4*a*, 4*b*, 4*c* and 4*d* are provided with accommodating containers for accommodating the yellow, magenta, cyan and black toner and are developing means for developing the electrostatic images on the photosensitive drum 1*a*, 1*b*, 1*c* and 1*d* using the toner.

The toner images formed on the photosensitive drums 1*a*, 1*b*, 1*c*, 1*d* are primary-transferred onto an intermediary transfer belt 7 in primary-transfer portions (primary-transfer positions) N1*a*, N1*b*, N1*c* and N1*d*. In this manner, four color toner images are transferred superimposedly onto the intermediary transfer belt 7. The primary-transfer will be described in detail hereinafter.

Photosensitive member drum cleaning devices 6*a*, 6*b*, 6*c* and 6*d* remove residual toner remaining on the photosensitive drums 1*a*, 1*b*, 1*c* and 1*d* without transferring in the primary-transfer portions N1*a*, N1*b*, N1*c* and N1*d*.

The intermediary transfer belt 7 (intermediary transfer member) is a movable intermediary transfer member onto which the toner images are to be transferred from the photosensitive drums 1*a*, 1*b*, 1*c*, 1*d*. In this embodiment, the intermediary transfer belt 7 has a two layer structure including a base layer and a surface layer. The base layer is at an inner side (inner peripheral surface side, stretching member side) and contacts the stretching member. The surface layer is at an outer surface side (outer peripheral surface side, image bearing member side) and contacts the photosensitive drum. The base layer comprises a resin material such as polyimide, polyamide, PEN, PEEK, or various rubbers, with a proper amount of an antistatic agent such as carbon black incorporated. The base layer of the intermediary transfer belt 7 is formed to have a volume resistivity of $10^2$-$10^7$ Ωcm thereof. In this embodiment, the base layer comprises the polyimide, having a center thickness of approx. 45-150 μm, in the form of a film-like endless belt. Further, as a surface layer, an acrylic coating having a volume resistivity of $10^{13}$-$10^{16}$ Ωcm in a thickness direction is applied. That is, the volume resistivity of the base layer is lower than that of the surface layer.

In the case where the intermediary transfer member has two or more layer structure, the volume resistivity of the outer peripheral surface side layer is higher than that of the inner peripheral surface side layer.

The thickness of the surface layer is 0.5-10 μm. Of course, the thickness is not intended to be limited to these numerical values.

The inner peripheral surface of the intermediary transfer belt 7 is stretched while contacting the intermediary transfer belt 7 by rollers 10, 11 and 12 as stretching members. The roller 10 is driven by a motor as a driving source, thus functioning as a driving roller for driving the intermediary transfer belt 7. Further, the roller 10 is also an inner secondary-transfer roller urged toward the outer secondary-transfer roller 13 with the intermediary transfer belt. The roller 11 functions as a tension roller for applying a predetermined tension to the intermediary transfer belt 7. In addition, the roller 11 functions also as a correction roller for preventing snaking motion of the intermediary transfer belt 7. A belt tension to the tension roller 11 is constituted so as to be approx. 5-12 kgf. By this belt tension applied, nips as primary-transfer portions N1*a*, N1*b*, N1*c* and N1*d* are formed between the intermediary transfer belt 7 and the respective photosensitive drums 1*a*-1*d*. The inner secondary-transfer roller 62 is drive by a motor excellent in constant speed property, and functions as a driving roller for circulating and driving the intermediary transfer belt 7.

The recording material is accommodated in a sheet tray for accommodating the recording material P. The recording material P is picked up by a pick-up roller at predetermined timing from the sheet tray and is fed to a registration roller. In synchronism with the feeding of the toner image on the intermediary transfer belt, the recording material P is fed by the registration roller to the secondary-transfer portion N2 for transferring the toner image from the intermediary transfer belt onto the recording material.

The outer secondary-transfer roller 13 (transfer member) is a secondary-transfer member for forming the secondary-transfer portion N2 (secondary-transfer position) together with the inner secondary-transfer roller 13 by urging the inner secondary-transfer roller 10 via the intermediary transfer belt 7 from the outer peripheral surface of the intermediary transfer belt 7. A secondary-transfer high-voltage (power) source 22 as a secondary-transfer voltage source is connected to the outer secondary-transfer roller 13, and is a voltage source (power source) capable of applying a voltage to the outer secondary-transfer roller 13.

When the recording material P is fed to the secondary-transfer portion N2, a secondary-transfer electric field is formed by applying, to the outer secondary-transfer roller 13, the secondary-transfer voltage of an opposite polarity to the toner, so that the toner image is transferred from the intermediary transfer belt 7 onto the recording material.

Incidentally, the inner secondary-transfer roller 10 is formed with EPDM rubber. The inner secondary-transfer roller is set at 20 mm in diameter, 0.5 mm in rubber thickness and 70° in hardness (Asker-C). The outer secondary-transfer roller 13 includes an elastic layer formed of NBR rubber, EPDM rubber or the like, and a core metal. The outer secondary-transfer roller 13 is formed to have a diameter of 24 mm.

With respect to a direction in which the intermediary transfer belt 7 moves, in a downstream side than the secondary-transfer portion N2, an intermediary transfer belt cleaning device 14 for removing a residual toner and paper powder which remain on the intermediary transfer belt 7 without being transferred onto the recording material at the secondary-transfer portion N2 is provided.

[Primary-Transfer Electric Field Formation in Primary-Transfer-High-Voltage-Less-System]

This embodiment employs a constitution in which the voltage source exclusively for the primary-transfer is omitted for cost reduction. Therefore, in this embodiment, in order to electrostatically primary-transfer the toner image from the photosensitive drum onto the intermediary transfer belt 7, the secondary-transfer voltage source 22 is used (hereinafter, this constitution is referred to as a primary-transfer-high-voltage-less-system).

However, in a constitution in which the roller for stretching the intermediary transfer belt is directly connected to the ground, even when the secondary-transfer voltage source 210 applies the voltage to the outer secondary-transfer roller 64, there is a liability that most of the current flows into the stretching roller side, and the current does not flow into the photosensitive drum side. That is, even when the secondary-transfer voltage source 210 applies the voltage, the current does not flow into the photosensitive drums 50*a*, 50*b*, 50*c* and 50*d* via the intermediary transfer belt 56, so that the primary-transfer electric field for transferring the toner image does not act between the photosensitive drums and the intermediary transfer belt.

Therefore, in order to cause a primary-transfer electric field action to act in the primary-transfer-high-voltage-less-system, it is desirable that passive elements are provided between each of the stretching rollers 60, 61, 62 and 63 and the ground so as to pass the current toward the photosensitive drum side.

As a result, a potential of the intermediary transfer belt becomes high, so that the primary-transfer electric field acts between the photosensitive drum and the intermediary transfer belt.

Incidentally, in order to form the primary-transfer electric field in the primary-transfer-high-voltage-less-system, there is a need to pass the current along the circumferential direction of the intermediary transfer belt by applying the voltage from the secondary-transfer voltage source 210 (power source). However, if a resistance of the intermediary transfer belt itself is high, a voltage drop of the intermediary transfer belt with respect to a movement direction (circumferential direction) in which the intermediary transfer belt moves becomes large. As a result, there is also a liability that the current is less liable to pass through the intermediary transfer belt along the circumferential direction toward the photosensitive drums 1*a*, 1*b*, 1*c* and 1*d*. For that reason, the intermediary transfer belt may desirably have a low-resistant layer. In this embodiment, in order to suppress the voltage drop in the intermediary transfer belt, the base layer of the intermediary transfer belt is formed so as to have a surface resistivity of $10^2$ Ω/square or more and $10^8$ Ω/square or less. Further, in this embodiment, the intermediary transfer belt has the two-layer structure. This is because by disposing the high-resistant layer as the surface layer, the current flowing into a non-image portion is suppressed, and thus a transfer property is further enhanced easily. Of course, the layer structure is not intended to be limited to this structure. It is also possible to employ a single-layer structure or a structure of three layers or more.

Next, by using FIG. 2, a primary-transfer contrast which is a difference between the potential of the photosensitive drum and the potential of the intermediary transfer belt will be described.

Figure 2:
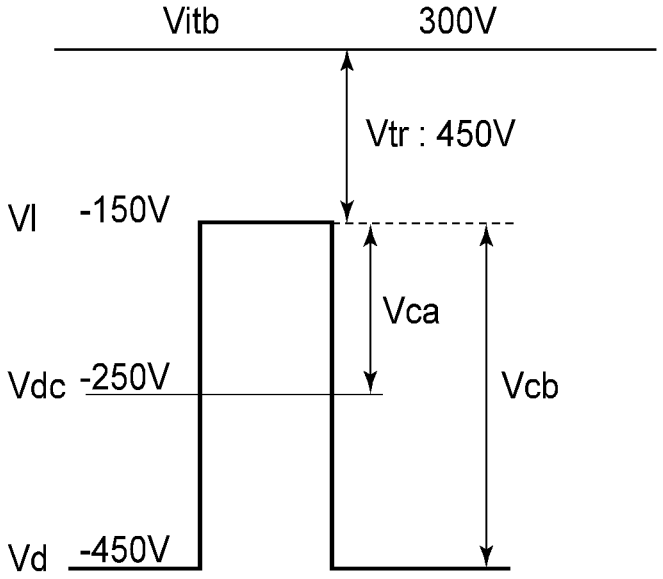
FIG. 2 is an illustration showing a relationship between a transferring potential and an electrostatic image potential.

FIG. 2 is the case where the surface of the photosensitive drum 1 is charged by the charging means 2, and the photosensitive drum surface has a potential Vd (−450 V in this embodiment). Further, FIG. 2 is the case where the surface of the charged photosensitive drum is exposed to light by the exposure means 3, and the photosensitive drum surface has V1 (−150 V in this embodiment). The potential Vd is the potential of the non-image portion where the toner is not deposited, and the potential V1 is the potential of an image portion where the toner is deposited. Vitb shows the potential of the intermediary transfer belt.

The surface potential of the drum is controlled on the basis of a detection result of a potential sensor provided in proximity to the photosensitive drum in a downstream side of the charging and exposure means and in upstream of the developing means.

The potential sensor detects the non-image portion potential and the image portion potential of the photosensitive drum surface, and controls a charging potential of the charging means on the basis of the non-image portion potential and controls an exposure light amount of the exposure means on the basis of the image portion potential.

By this control, with respect to the surface potential of the photosensitive drum, both potentials of the image portion potential and the non-image portion potential can be set at proper values.

With respect to this charging potential on the photosensitive drum, a developing bias Vdc (−250 V as a DC component in this embodiment) is applied by the developing device 4, so that a negatively charged toner is formed in the photosensitive drum side by development.

A developing contrast Vca which is a potential difference between the V1 of the photosensitive drum and the developing bias Vdc is: −150 (V)−(−250 (V))=100 (V).

An electrostatic image contrast Vcb which is a potential difference between the image portion potential V1 and the non-image portion potential Vd is: −150 (V)−(−450 (V))=300 (V).

A primary-transfer contrast Vtr which is a potential difference between the image portion potential V1 and the potential Vitb (300 V in this embodiment) of the intermediary transfer belt is: 300 V−(−150 (V))=450 (V).

Incidentally, in this embodiment, a constitution in which the potential sensor is disposed by attaching importance to accuracy of detection of the photosensitive drum potential is employed, but the present invention is not intended to be limited to this constitution. It is also possible to employ a constitution in which a relationship between the electrostatic image forming condition and the potential of the photosensitive drum is stored in ROM in advance by attaching importance to the cost reduction without disposing the potential sensor, and then the potential of the photosensitive drum is controlled on the basis of the relationship stored in the ROM.

[Zener Diode]

In the primary-transfer-high-voltage-less-system, the primary-transfer is determined by the primary-transfer contrast (primary-transfer electric field) which is the potential difference between the potential of the intermediary transfer belt and the potential of the photosensitive drum. For that reason, in order to stably form the primary-transfer contrast, it is desirable that the potential of the intermediary transfer belt is kept constant.

Therefore, in this embodiment, Zener diode is used as a constant-voltage element disposed between the stretching roller and the ground. Incidentally, in place of the Zener diode, a varister may also be used.

Figure 3:
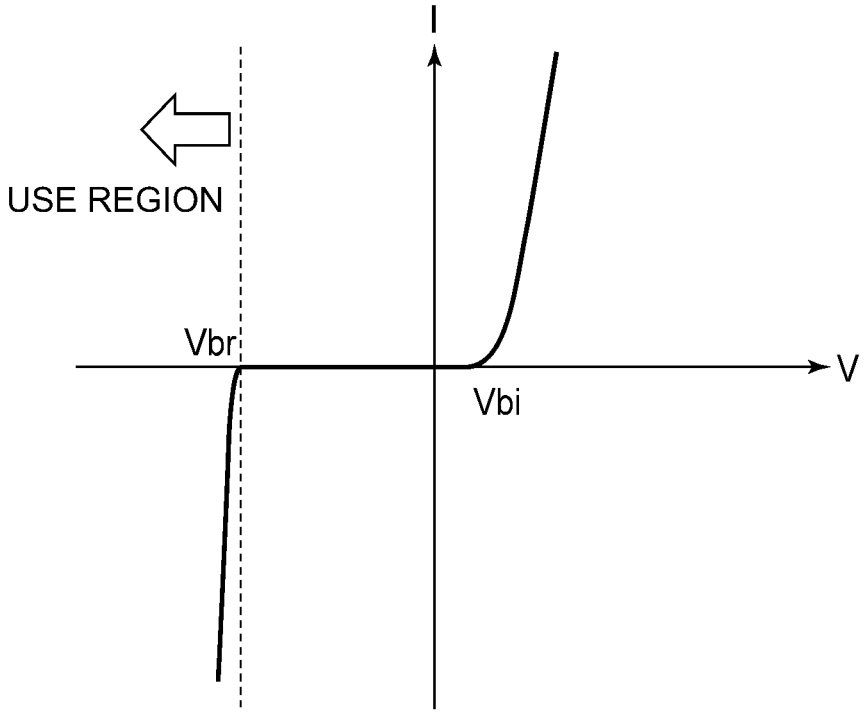
FIG. 3 is an illustration showing an IV characteristic of a Zener diode.

FIG. 3 shows a current-voltage characteristic of the Zener diode. The Zener diode causes the current to little flow until a voltage of Zener breakdown voltage Vbr or more is applied, but has a characteristic such that the current abruptly flows when the voltage of the Zener breakdown voltage or more is applied. That is, in a range in which the voltage applied to the Zener diode 15 is the Zener breakdown voltage (breakdown voltage) or more, the voltage drop of the Zener diode 15 is such that the current is caused to flow so as to maintain a Zener voltage.

By utilizing such a current-voltage characteristic of the Zener diode, the potential of the intermediary transfer belt 7 is kept constant.

That is, in this embodiment, the Zener diode 15 is disposed as the constant-voltage element between each of the stretching rollers 10, 11 and 12 and the ground.

In addition, during the primary-transfer, the secondary-transfer voltage source 22 applies the voltage so that the voltage applied to the Zener diode 15 is kept at the Zener breakdown voltage. As a result, during the primary-transfer, the belt potential of the intermediary transfer belt 7 can be kept constant.

In this embodiment, between each of the stretching rollers and the ground, 12 pieces of the Zener diode 15 providing a standard value Vbr, of 25 V, of the Zener breakdown voltage are disposed in a state in which they are connected in series. That is, in the range in which the voltage applied to the Zener diode is kept at the Zener breakdown voltage, the potential of the intermediary transfer belt is kept constant at the sum of Zener breakdown voltages of the respective Zener diodes, i.e., 25×12=300 V.

Of course, the present invention is not intended to be limited to the constitution in which the plurality of Zener diodes are used. It is also possible to employ a constitution using only one Zener diode.

Of course, the surface potential of the intermediary transfer belt is not intended to be limited to a constitution in which the surface potential is 300 V. The surface potential may desirably be appropriately set depending on the species of the toner and a characteristic of the photosensitive drum.

In this way, when the voltage is applied by the secondary-transfer voltage source 210, the potential of the Zener diode maintains a predetermined potential, so that the primary-transfer electric field is formed between the photosensitive drum and the intermediary transfer belt. Further, similarly as the conventional constitution, when the voltage is applied by the secondary-transfer high-voltage source, the secondary-transfer electric field is formed between the intermediary transfer belt and the outer secondary-transfer roller.

[Controller]

Figure 4:
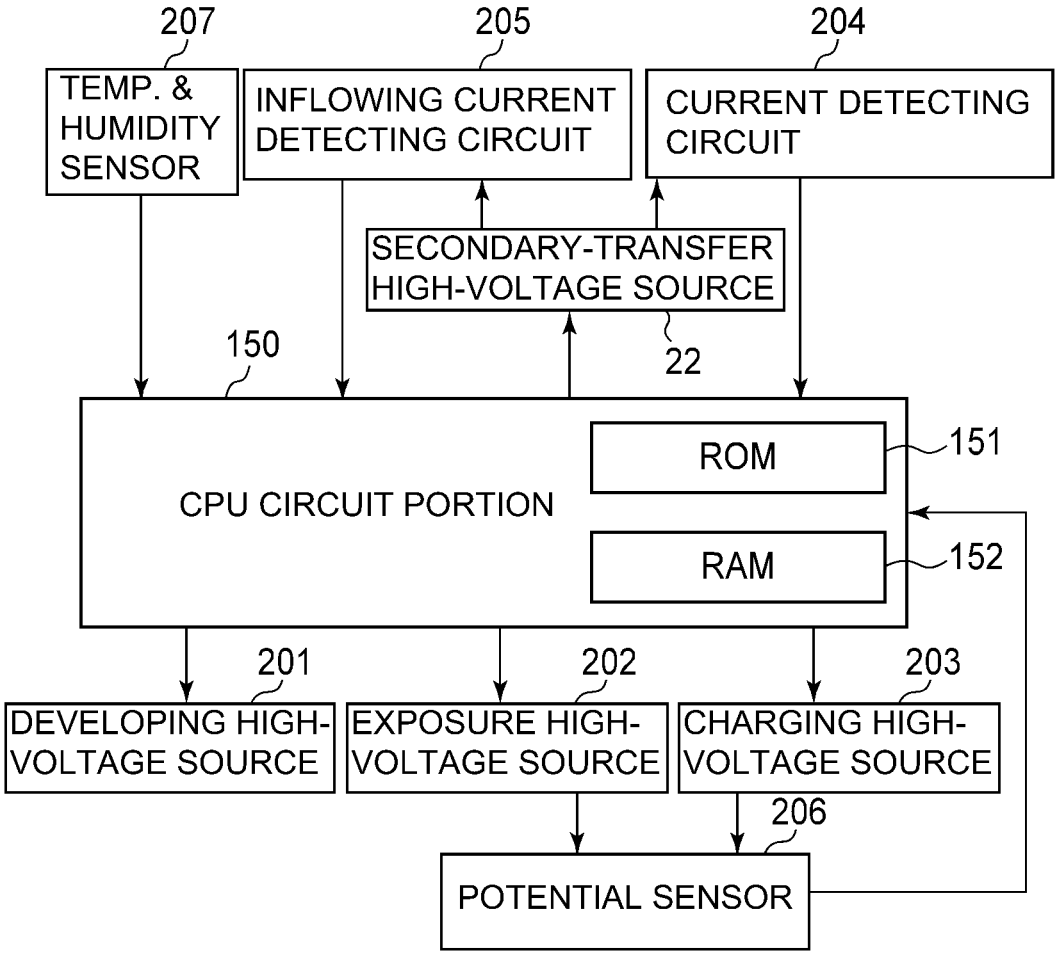
FIG. 4 is an illustration showing a block diagram of a control.

A constitution of a controller for effecting control of the entire image forming apparatus will be described with reference to FIG. 4. The controller includes a CPU circuit portion 150 (controller) as shown in FIG. 4. The CPU circuit portion 150 incorporates therein CPU, ROM 151 and RAM 152. A secondary-transfer portion current detecting circuit 204 is a circuit (detecting portion, first detecting portion) for detecting a current passing through the outer secondary-transfer roller. A stretching-roller-inflowing-current detecting circuit 205 (second detecting portion) is a circuit for detecting a current flowing into the stretching roller. A potential sensor 206 is a sensor for detecting the potential of the photosensitive drum surface. A temperature and humidity sensor 207 is a sensor for detecting a temperature and a humidity.

Into the CPU circuit portion 150, information from the secondary-transfer portion current detecting circuit 204, the stretching-roller-inflowing-current detecting circuit 205, the potential sensor 206 and the temperature and humidity sensor 207 is inputted. Then, the CPU circuit portion 150 effects integral control of the secondary-transfer voltage source 22, a developing high-voltage source 201, an exposure means high-voltage source 202 and a charging means high-voltage source 203 depending on control programs stored in the ROM 151. An environment table and a paper thickness correspondence table which are described later are stored in the ROM 151, and are called up and reflected by the CPU. The RAM 152 temporarily hold control data, and is used as an operation area of arithmetic processing with the control.

[Discriminating Function]

In this embodiment, in order to make the surface potential of the intermediary transfer belt not less than the Zener voltage, a step for discriminating a lower-limit voltage of the voltage applied by the secondary-transfer voltage source is executed. Description will be made using FIG. 5.

In this embodiment, in order to discriminate the lower-limit voltage, the stretching-roller-inflowing-current detecting circuit (second detecting portion) for detecting the current flowing into the ground via the Zener diode 15 is used. The stretching-roller-inflowing-current detecting circuit is connected between the Zener diode and the ground. That is, each of the stretching rollers are connected to the ground potential via the Zener diode and the stretching-roller-inflowing-current detecting circuit.

As shown in FIG. 3, the Zener diode has a characteristic such that the current little flows in a range in which the voltage drop of the Zener diode is less than the Zener breakdown voltage. For that reason, when the stretching-roller-inflowing-current detecting circuit does not detect the current, it is possible to discriminate that the voltage drop of the Zener diode is less than the Zener breakdown voltage. Further, when the stretching-roller-inflowing-current detecting circuit detects the current, it is possible to discriminate that the voltage drop of the Zener diode maintains the Zener breakdown voltage.

First, charging voltages for all the stations for Y, M, C and Bk are applied, so that the surface potential of the photosensitive drum is controlled at the non-image portion potential Vd.

Figure 5:
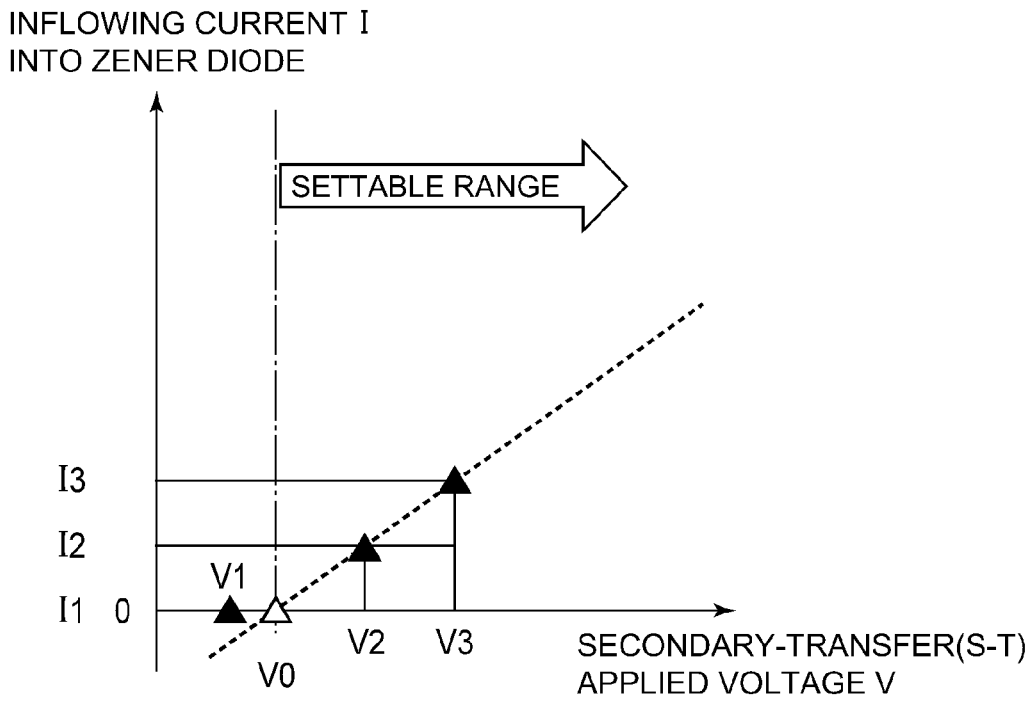
FIG. 5 is an illustration showing a relation between an inflowing current and an applied voltage.

Next, the secondary-transfer voltage source applies a test voltage. The test voltage applied by the secondary-transfer voltage source is increased linearly or stepwisely. In FIG. 5, the test voltage is increased stepwisely in the order of V1, V2 and V3. When the voltage applied by the secondary-transfer voltage source is V1, the stretching-roller-inflowing-current detecting circuit does not detect the current (I1=0 μA). When the voltage applied by the secondary-transfer voltage source is V2 and V3, the stretching-roller-inflowing-current detecting circuit detects I2 μA or I3 μA, respectively. Here, from a correlation between an applied voltage and a detected current in the case where the stretching-roller-inflowing-current detecting circuit detects the current, a current inflowing starting voltage V0 corresponding to the case where the current starts to flow into the Zener diode is calculated. That is, from a relationship among I2, I3, V2 and V3, by performing linear interpolation, the current inflowing starting voltage V0 is carried.

As the voltage applied by the secondary-transfer voltage source, by setting a voltage exceeding V0, the voltage drop of the Zener diode can be made so as to maintain the Zener breakdown voltage.

Figure 6:
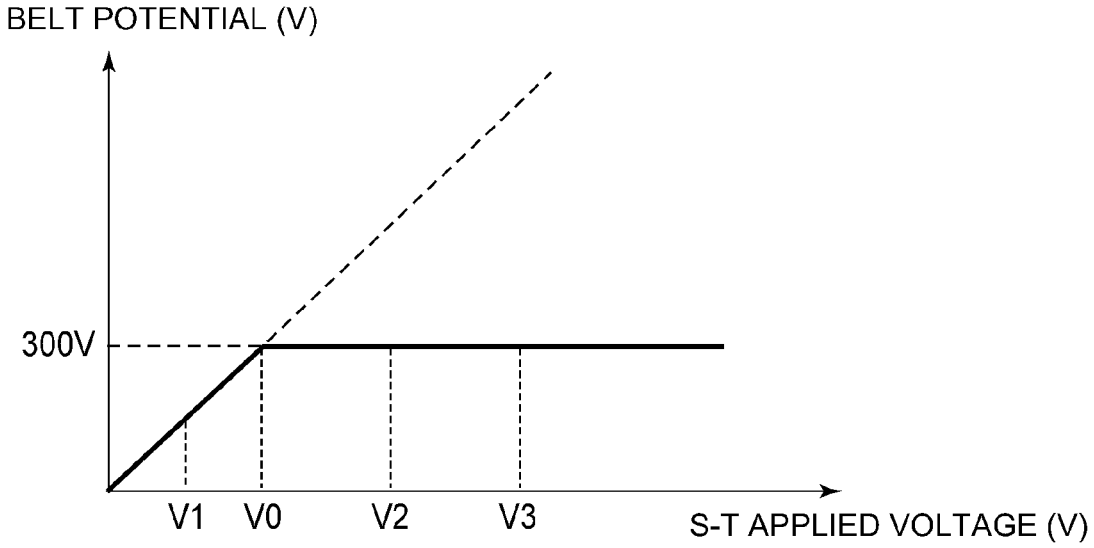
FIG. 6 is an illustration showing a relation between a belt potential and an applied voltage.

A relationship, at this time, between the voltage applied by the secondary-transfer voltage source and the belt potential of the intermediary transfer belt is shown in FIG. 6.

For example, in this embodiment, the Zener voltage of the Zener diode is set at 300 V. For that reason, in a range in which the potential of the intermediary transfer belt is less than 300 V, the current does not flow into the Zener diode, and when the belt potential of the intermediary transfer belt is 300 V, the current starts to flow into the Zener diode. Even when the voltage applied by the secondary-transfer voltage source is increased further, the belt potential of the intermediary transfer belt is controlled so as to be constant.

That is, in a range of less than V0 at which the flow of the current into the Zener diode is started to be detected, when the secondary-transfer bias is changed, the belt potential cannot be controlled at the constant voltage. In a range exceeding V0 at which the flow of the current into the Zener diode is started to be detected, even when the secondary-transfer bias is changed, the belt potential can be controlled at the constant voltage.

Incidentally, in this embodiment, before and after the current inflowing starting voltage are used as the test voltage, but the present invention is not intended to be limited to this constitution. As the test voltage, by setting a larger predetermined voltage in advance, it is also possible to employ a constitution in which all the test voltages exceeds the current inflowing starting voltage. In such a constitution, there is an advantage such that a discriminating step can be omitted.

Incidentally, in this embodiment, by attaching importance to enhancement of accuracy of calculation of the current inflowing starting voltage, a constitution in which a discriminating function for calculating the current inflowing starting voltage V0 is executed is employed. Of course, the present invention is not intended to be limited to this constitution. By attaching important to suppression of long downtime, not the constitution in which the discriminating function for calculating the current inflowing starting voltage V0 is executed, it is also possible to employ a constitution in which the current inflowing starting voltage V0 is stored in the ROM in advance.

[Test Mode for Setting Secondary-Transfer Voltage]

In this embodiment, in order to set the secondary-transfer voltage at which the toner image is to be transferred onto the recording material, a test mode which is called ATVC (Active Transfer Voltage Control) in which an adjusting voltage (test voltage) is applied is executed. This is a test mode for setting the secondary-transfer voltage and is executed during non-sheet-passing in which the recording material does not pass through the secondary-transfer portion. There is also a case where this test mode is executed when a region corresponding to a region between recording materials is in the secondary-transfer position in the case where the images are continuously formed. By the ATVC, it is possible to grasp a correlation between the voltage applied by the secondary-transfer voltage source and the current passing through the secondary-transfer portion.

When the ATVC is carried out, if the voltage drop of the Zener diode is less than the Zener breakdown voltage, there is a possibility that setting of the secondary-transfer voltage by the ATVC is not properly made.

Therefore, in this embodiment, in the case where the ATVC is carried out when no recording material exists at the secondary-transfer portion, the adjusting voltage is set so that the voltage drop of the Zener diode is kept at the Zener breakdown voltage.

Incidentally, the ATVC is carried out by controlling the secondary-transfer voltage source by the CPU circuit portion 150 when no recording material exists at the secondary-transfer portion. That is, the CPU circuit portion 150 functions as an executing portion for executing the ATVC for setting the secondary-transfer voltage.

In the ATVC, a plurality of adjusting voltages Va, Vb and Vd which are constant-voltage-controlled are applied by the secondary-transfer voltage source. Then, in the ATVC, currents Ia, Ib and Ic flowing when the adjusting voltages are applied are detected, respectively, by the secondary-transfer portion current detecting circuit 204 (detecting portion). This is because the correlation between the voltage and the current is grasped.

Set values of the adjusting voltages in this embodiment will be described.

In this embodiment, the current inflowing starting voltage V0 is calculated by the discriminating function. ΔV1 and ΔV2 are stored in advance in the ROM of the CPU circuit portion. The adjusting voltage Va is calculated by adding ΔV1 to the current inflowing starting voltage V0, the adjusting voltage Vb is calculated by adding ΔV2 to the adjusting voltage Va, and the adjusting voltage Vc is calculated by adding ΔV2 to the adjusting voltage Vb. When the above is summarized, the respective adjusting voltages Va, Vb and Vc are represented by the following formulas.

$$Va=V0+\Delta V1$$

$$Vb=Va+\Delta V2$$

$$Vc=Vb+\Delta V2$$

That is all the adjusting voltages Va, Vb and Vc including a lowest voltage Va of the adjusting voltages are set so as to exceed the current inflowing starting voltage V0. That is, during the execution of the ATVC, the voltages are set so that the voltage drop of the Zener diode is kept at the Zener breakdown voltage.

In the following, in the case where the Zener diode during the ATVC is less than the Zener breakdown voltage, how the setting of the secondary-transfer voltage by the ATVC influences will be described.

The ATVC obtains a relationship between a voltage applied to the secondary-transfer portion and a current. Here, the potential of the intermediary transfer belt opposing the outer secondary-transfer roller is the same potential as the potential generated in the Zener diode. The potential of the intermediary transfer belt during the secondary transfer is set so as to always maintain the Zener breakdown voltage. Assuming that the intermediary transfer belt potential is not more than the Zener breakdown voltage during the ATVC, the potential difference between the outer secondary-transfer roller and the intermediary transfer belt is shifted to a larger direction than the potential difference during the secondary-transfer. Then, a current more than a current which naturally flows will flow. That is, there is a possibility that the setting of the secondary-transfer voltage by the ATVC cannot be properly made. Therefore, the setting is made so that the voltage drop of the Zener diode can always maintain the Zener breakdown voltage during the ATVC.

[Secondary-Transfer Target Current Setting]

On the basis of a correlation between the plurality of applied adjusting voltages, Va, Vb and Vc and the measured currents Ia, Ib and Ic, a voltage Vi for causing a secondary-transfer target current It required for the secondary-transfer to flow is calculated. The secondary-transfer target current It is set on the basis of a matrix shown in Table 1.

TABLE 1

| | WC*1 (g/kg) | | | | | | |
|---|---|---|---|---|---|---|---|
| | 0.8 | 2 | 6 | 9 | 15 | 18 | 22 |
| STTC*2 (μA) | 32 | 31 | 30 | 30 | 29 | 28 | 25 |

*1"WC" represents water content.
*2"STTC" represents the secondary-transfer target current.

Table 1 is a table stored in a storing portion provided in the CPU circuit portion 150. This table sets and divides the secondary-transfer target current It depending on absolute water content (g/kg) in an atmosphere. This reason will be described. When the water content becomes high, a toner charge amount becomes small. Therefore, when the water content becomes high, the secondary-transfer target current It is set so as to become small. That is, when the water content is increased, the secondary-transfer target current is decreased. Incidentally, the absolute water content is calculated by the CPU circuit portion 150 from the temperature and relative humidity which are detected by the temperature and humidity sensor 207. Incidentally, in this embodiment, the absolute water content is used, but the water content is not intended to be limited to this. In place of the absolute water content, it is also possible to use the humidity.

Here, the voltage V1 for passing It is a voltage for passing It in the case where no recording material exists at the secondary-transfer portion. However, the secondary-transfer is carried out when the recording material exists at the secondary-transfer portion. Therefore, it is desirable that a resistance for the recording material is taken into account. Therefore, a recording material sharing voltage Vii is added to the voltage Vi. The recording material sharing voltage Vii is set on the basis of a matrix shown in Table 2.

TABLE 2

| PLAIN | | WC*1 | | | | | | |
|---|---|---|---|---|---|---|---|---|
| PAPER | | 0.8 | 2 | 6 | 9 | 15 | 18 | 22 |
| 64-79 (gsm) | | | | | | | | |
| (UNIT: V) | OS*2 | 900 | 900 | 850 | 800 | 750 | 500 | 400 |
| | ADS*3 | 1000 | 1000 | 950 | 900 | 850 | 750 | 500 |
| | MDS*4 | 1000 | 1000 | 950 | 900 | 850 | 750 | 500 |
| 80-105 (gsm) | | | | | | | | |
| (UNIT: V) | OS*2 | 950 | 950 | 900 | 850 | 800 | 550 | 450 |
| | ADS*3 | 1050 | 1050 | 1000 | 950 | 900 | 800 | 550 |
| | MDS*4 | 1050 | 1050 | 1000 | 950 | 900 | 800 | 550 |
| 106-128 (gsm) | | | | | | | | |
| (UNIT: V) | OS*2 | 1000 | 1000 | 950 | 900 | 850 | 600 | 500 |
| | ADS*3 | 1100 | 1100 | 1050 | 1000 | 950 | 850 | 600 |
| | MDS*4 | 1100 | 1100 | 1050 | 1000 | 950 | 850 | 600 |
| 129-150 (gsm) | | | | | | | | |
| (UNIT: V) | OS*2 | 1050 | 1050 | 1000 | 950 | 900 | 650 | 550 |
| | ADS*3 | 1150 | 1150 | 1100 | 1050 | 1000 | 900 | 650 |
| | MDS*4 | 1150 | 1150 | 1100 | 1050 | 1000 | 900 | 650 |

*1"WC" represent the water content.
*2"OS" represents one side (printing).
*3"ADS" represents automatic double side (printing).
*4"MDS" represents manual double side (printing).

Table 2 is a table stored in the storing portion provided in the CPU circuit portion 150. This table sets and divides the recording material sharing voltage Vii depending on the absolute water content (g/kg) in an atmosphere and a recording material basis weight (g/m$^2$). When the basis weight is increased, the recording material sharing voltage Vii is increased. This is because when the basis weight is increased, the recording material becomes thick and therefore an electric resistance of the recording material is increased. Further, when the absolute water content is increased, the recording material sharing voltage Vii is decreased. This is because when the absolute water content is increased, the content of water contained in the recording material is increased, and therefore the electric resistance of the recording material is increased. Further, the recording material sharing voltage Vii is larger during automatic double-side printing and during manual double-side printing than during one-side printing. Incidentally, the basis weight is a unit showing a weight per unit area (g/m$^2$), and is used in general as a value showing a thickness of the recording material. With respect to the basis weight, there are the case where a user inputs the basis weight at an operating portion and the case where the basis weight of the recording material is inputted into the accommodating portion for accommodating the recording material. On the basis of these pieces of information, the CPU circuit portion 150 discriminate the basis weight.

A voltage (Vi+Vii) obtained by adding the recording material sharing voltage Vii to Vi for passing the secondary-transfer target current It is set, by the CPU circuit portion 150, as a secondary-transfer target voltage Vt, for secondary-transfer, which is constant-voltage-controlled. That is, the CPU circuit portion 150 functions as a controller for controlling the secondary-transfer voltage. As a result, a proper voltage value is set depending on an adjusting voltage environment and paper thickness. Further, during the secondary-transfer, the secondary-transfer voltage is applied in a constant-voltage-controlled state by the CPU circuit portion 150, and therefore even when a width of the recording material is changed, the secondary-transfer is carried out in a stable state.

[Timing of Control]

Figure 7:
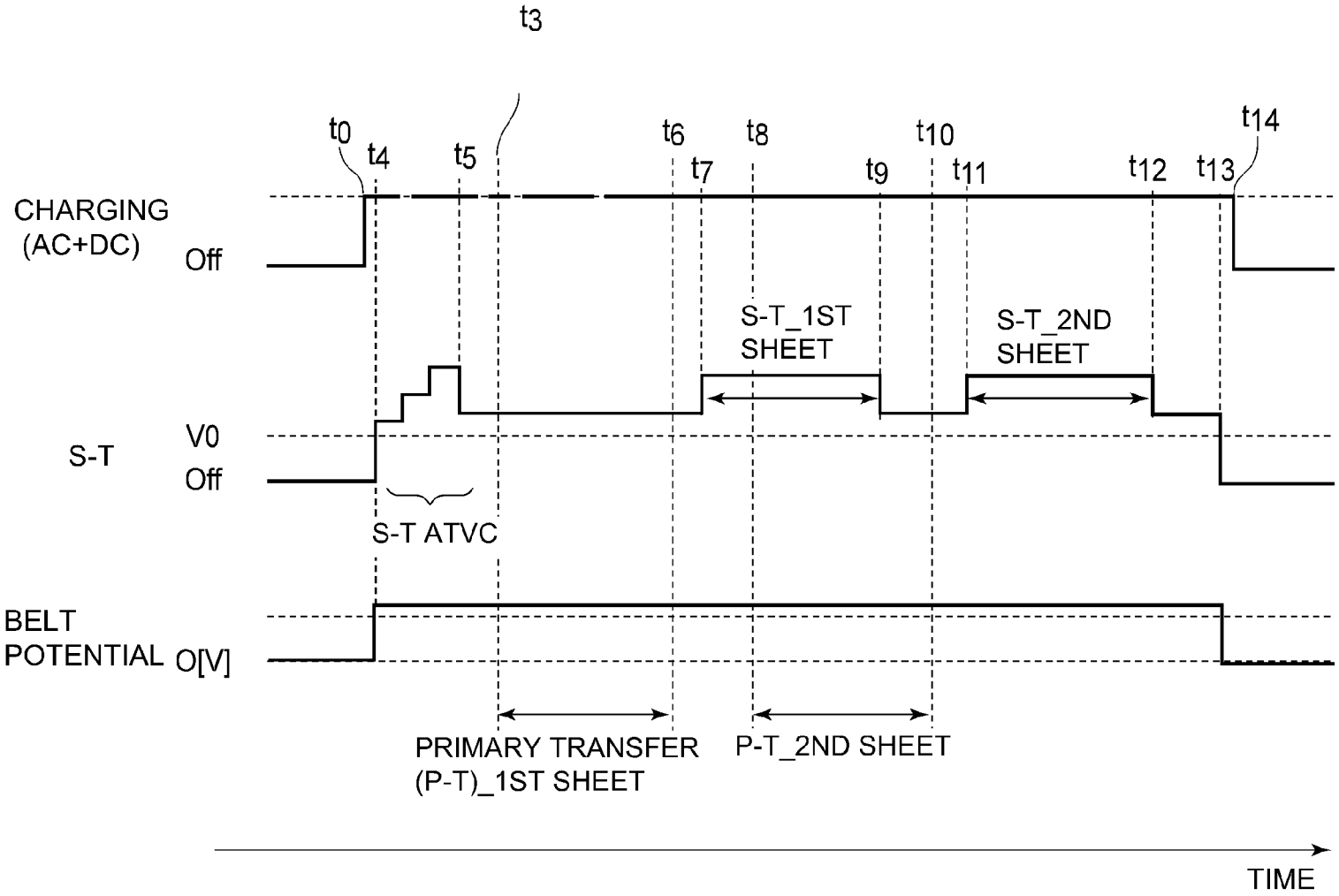
FIG. 7 is a time chart of a control of a secondary-transfer voltage source.

FIG. 7 shows a timing chart of a charging voltage (V, M, C, Bk), applied voltage of the secondary-transfer voltage source, primary-transfer and secondary-transfer. Incidentally, FIG. 7 is the case where the images are continuously formed on the recording materials.

When an image forming signal is inputted, the charging voltage is turned on (t0). Thereafter, the ATVC as an adjusting function for the secondary-transfer is carried out in a period front t4 to t5. Thereafter, in a period from t7 to t9, the secondary-transfer is executed. The secondary-transfer is carried out by applying, when there is a first sheet of the recording material at the secondary-transfer portion, the secondary-transfer voltage set on the basis of the ATVC. Thereafter, in a period from t11 to t12, the secondary-transfer for a second sheet of the recording material passing through the secondary-transfer portion is executed. Thereafter, the voltage applied to the outer secondary-transfer roller is turned off (t13), and the charging is turned off (t14).

Further, in this embodiment, in this embodiment, the primary-transfer for the first sheet of the recording material ends at timing (t6) after t5 and before t7.

When the adjusting voltage is applied, if the voltage drop of the Zener diode is less than the Zener breakdown voltage, there is a liability that a result obtained by the ATVC is not correct. Therefore, in this embodiment, all the adjusting voltages Va, Vb and Vc in the ATVC are set so that the voltage drop of the Zener diode maintains the Zener breakdown voltage. That is, $Va=V0+\Delta V1>V0$, $Vb=Va+\Delta V2>V0$ and $Vc=Vb+\Delta V2>V0$. As a result, when the ATVC are executed, it is always suppressed that the voltage drop of the Zener diode is less than the Zener breakdown voltage, and therefore it is possible to accurately set the secondary-transfer voltage by the ATVC.

Second Embodiment

Figure 8:
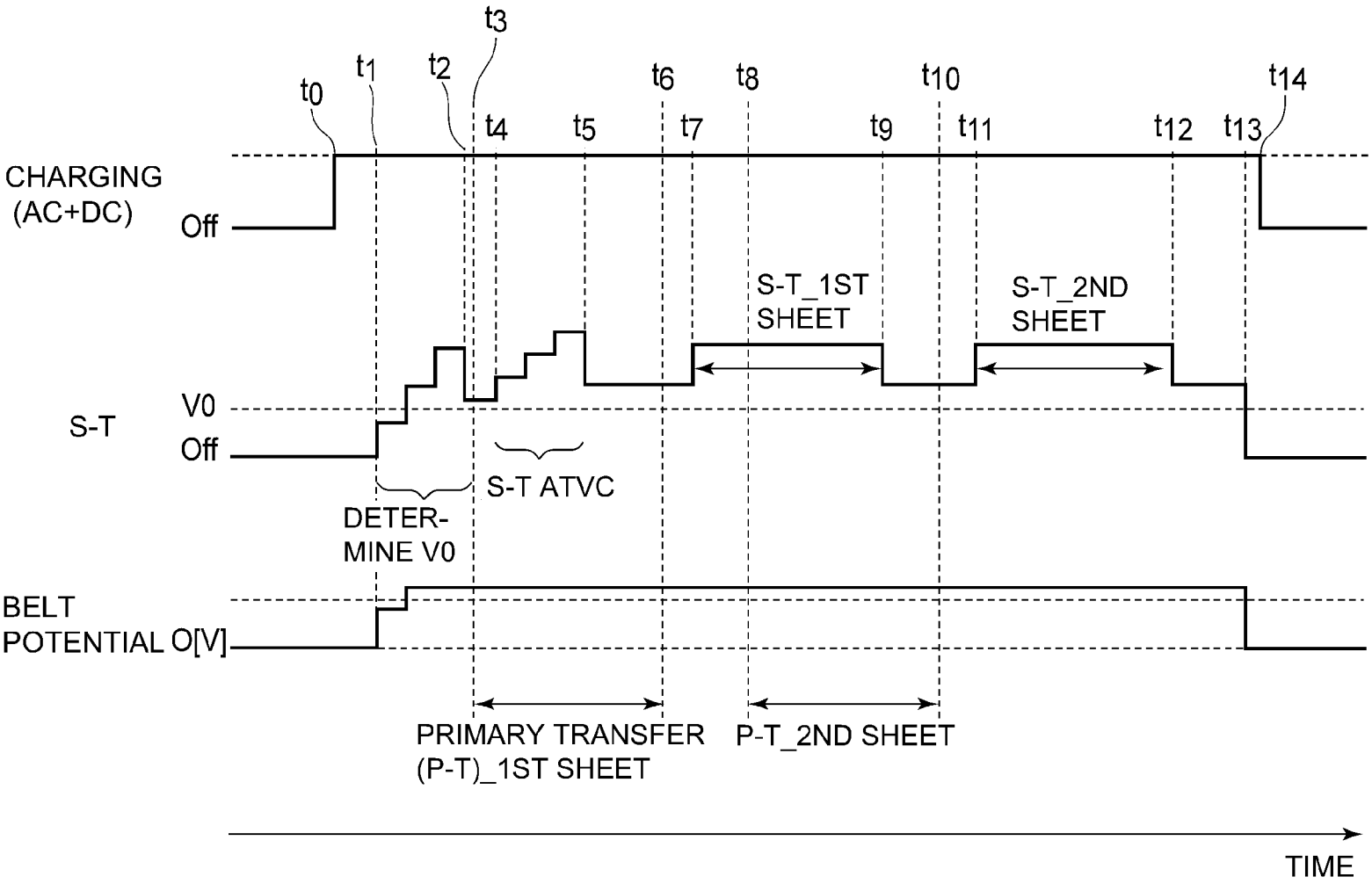
FIG. 8 is a time chart of a control of the secondary-transfer voltage source in another embodiment.

FIG. 8 shows a timing chart of a charging voltage (V, M, C, Bk), applied voltage of the secondary-transfer voltage source, primary-transfer and secondary-transfer.

When an image forming signal is inputted, the charging voltage is turned on (t0). Thereafter, the discriminating function for discriminating the current inflowing starting voltage V0 is executed in a period from t1 to t2. Thereafter, the ATVC as an adjusting function for the secondary-transfer is carried out in a period front t4 to t5. Thereafter, in a period from t7 to t9, the secondary-transfer is executed. The secondary-transfer is carried out by applying, when there is a first sheet of the recording material at the secondary-transfer portion, the secondary-transfer voltage set on the basis of the ATVC. Thereafter, in a period from t11 to t12, the secondary-transfer for a second sheet of the recording material passing through the secondary-transfer portion is executed. Thereafter, the voltage applied to the outer secondary-transfer roller is turned off (t13), and the charging is turned off (t14).

In this embodiment, the primary-transfer for the first sheet of the recording material starts a timing (t3) after t2 and before t4, and ends at timing (t6) after t5 and before t7.

For that reason, in a period from t4 to t5, in the state in which no recording material exists at the secondary-transfer portion, the primary-transfer for the first sheet of the recording material and the ATVC are executed in parallel. When the adjusting voltage is applied, if the voltage drop of the Zener diode is less than the Zener breakdown voltage, there is a possibility that the setting of the secondary-transfer voltage is not properly made.

Therefore, in this embodiment, all the adjusting voltages Va, Vb and Vc in the ATVC are set so that the voltage drop of the Zener diode maintains the Zener breakdown voltage. That is, $Va=V0+\Delta V1>V0$, $Vb=Va+\Delta V2>V0$ and $Vc=Vb+\Delta V2>V0$. As a result, even when the ATVC are executed, it is suppressed that the voltage drop of the Zener diode is less than the Zener breakdown voltage, and therefore the setting of the secondary-transfer voltage by the ATVC is properly made.

That is, in this embodiment, even when the ATVC is carried out when no recording material exists at the secondary-transfer portion, the voltage drop of the Zener diode is made so as not to be less than the Zener breakdown voltage. For that reason, the setting of the secondary-transfer voltage by the ATVC is properly made.

Embodiment 3

In Embodiment 3, the ATVC is executed by detecting the voltage, by a detecting circuit for detecting the voltage, of the secondary-transfer voltage source 22 when a test current is passed by subjecting the secondary-transfer voltage source 22 to constant-current control.

In a period from t4 to t5, the flowing of the test current which is constant-current-controlled is executed.

Figure 9:
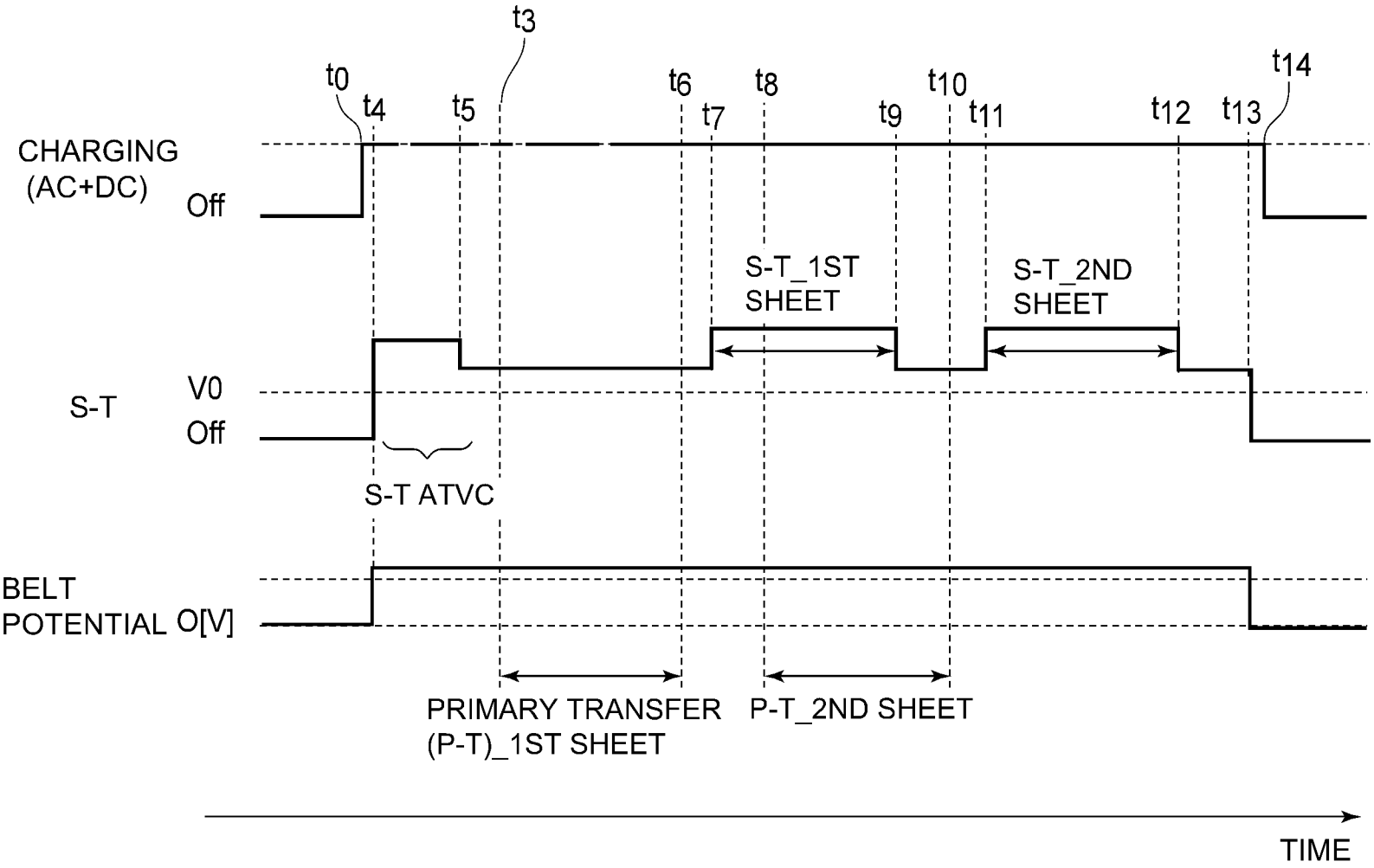
FIG. 9 is a time chart of a control of the secondary-transfer voltage source in another embodiment.

FIG. 9 shows a timing chart of the charging voltage (Y, M, C, Bk), the applied voltage of the secondary-transfer voltage source, the primary-transfer and the secondary-transfer.

In this embodiment, the test current of the secondary-transfer voltage source 22 is set as a target current value, and the ATVC is executed in a period from t4 to t5.

In this embodiment, the voltage of the secondary-transfer voltage source 22 when the test current is passed is set at the voltage where the Zener breakdown voltage can be maintained.

Further, a voltage obtained by adding the recording material sharing voltage to the voltage detected during the ATVC is applied to the outer secondary-transfer roller during the secondary-transfer from t7 to t9.

In this embodiment, the voltage when the test current is passed is set at the voltage where the Zener breakdown voltage can be maintained, and therefore the setting of the secondary-transfer voltage by the ATVC is properly made.

Incidentally, in this embodiment, the image forming apparatus for forming the electrostatic image by the electrophotographic type is described, but this embodiment is not intended to be limited to this constitution. It is also possible to use an image forming apparatus for forming the electrostatic image by an electrostatic force type, not the electrophotographic type.

INDUSTRIAL APPLICABILITY

In the constitution in which the predetermined voltage is generated in the intermediary transfer member by the constant-voltage element, it is possible to avoid the problem, such that the proper voltage cannot be obtained, capable of generating in the case where the test mode in which the test voltage is applied is carried out.

The invention claimed is:

1. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential and configured to form a predetermined voltage by passing of a current therethrough, said constant-voltage element comprising a Zener diode or a varistor;

wherein the predetermined voltage is a breakdown voltage of the constant-voltage element, a power source to form both of a secondary transfer electric field at the secondary-transfer position and a primary-transfer electric field at the primary-transfer position by applying a voltage to the transfer member to pass the current through the constant-voltage element;

a detecting portion configured to detect the current passing through the transfer member;

an executing portion configured to execute a test mode in which a test voltage is applied to the transfer member by the power source to detect the current by the detecting portion when no recording material exists at the secondary-transfer position; and a controller configured to control a voltage to be applied to the transfer member by the power source when the recording material exists at the secondary-transfer position on the basis of the current detected by the detecting portion in the test mode, wherein the controller controls the test voltage applied by the power source so that the current passes through the constant-voltage element in a period of the test mode.

2. An image forming apparatus according to claim 1, wherein the power source voltage that is controlled by the controller includes a voltage lower than a voltage for forming the secondary-transfer electric field.

3. An image forming apparatus according to claim 1, wherein the detecting portion is a first detecting portion, the image forming apparatus comprises a second detecting portion configured to detect the current passing through the constant-voltage element, the executing portion carries out detection at the second detecting portion by applying the test voltage to the transfer member at timing before the toner image is primary-transferred in order to set the voltage to be applied to the transfer member so that the current passes through the constant-voltage element, and the controller controls the power source on the basis of a detection result of the second detecting portion.

4. An image forming apparatus according to claim 3, wherein the executing portion carries out the detection at the second detecting portion in the period of the test mode.

5. An image forming apparatus according to claim 1, wherein the executing portion executes the test mode when a region of the intermediary transfer member corresponding to a region between the recording material and a subsequent recording material in the case where images are continuously formed is in the secondary-transfer position.

6. An image forming apparatus according to claim 1, wherein the intermediary transfer member has a structure of two layers or more, and a volume resistivity of the layer in the outer peripheral surface side is higher than a volume resistivity of the layer in an inner peripheral surface side.

7. An image forming apparatus according to claim 1, wherein the intermediary transfer member is an intermediary transfer belt, and the image forming apparatus comprises a plurality of stretching members configured to stretch the intermediary transfer belt in contact with an inner peripheral surface of the intermediary transfer belt.

8. An image forming apparatus according to claim 7, wherein the stretching members are stretching rollers having electroconductivity, and the stretching rollers are electrically connected with the constant-voltage element to electrically connect the intermediary transfer member with the constant-voltage element.

9. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential and configured to form a predetermined voltage by passing of a current therethrough, said constant-voltage element comprising a Zener diode or a varistor;

wherein the predetermined voltage is a breakdown voltage of the constant-voltage element, a power source configured to form both of a secondary-transfer electric field at the secondary-transfer position and a primary-transfer electric field at the primary-transfer position by applying a voltage to the transfer member to pass the current through the constant-voltage element;

a detecting portion configured to detect the voltage applied to the transfer member;

an executing portion configured to execute a test mode in which a test current is passed through the transfer member by the power source to detect the voltage by the detecting portion when exists no recording material at the secondary-transfer position; and a controller configured to control a voltage to be applied to the transfer member by the power source when the recording material exists at the secondary-transfer position on the basis of the voltage detected by the detecting portion in the test mode, wherein the controller controls the test voltage applied by the power source so that the current passes through the constant-voltage element in a period of the test mode.

10. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential and configured to form a predetermined voltage by passing of a current therethrough, said constant-voltage element comprising a Zener diode or a varistor;

a power source to form both of a secondary transfer electric field at the secondary-transfer position and a primary-transfer electric field at the primary-transfer position by applying a voltage to the transfer member to pass the current through the constant-voltage element;

a detecting portion configured to detect the current passing through the transfer member;

an executing portion configured to execute a test mode in which a test voltage is applied to the transfer member by the power source to detect the current by the detecting portion when no recording material exists at the secondary-transfer position; and a controller configured to control a voltage to be applied to the transfer member by the power source when the recording material exists at the secondary-transfer position on the basis of the current detected by the detecting portion in the test mode, wherein the controller controls the test voltage applied by the power source so that the current passes through the constant-voltage element in a period of the test mode, wherein said executing portion detects the current by the detecting portion for each of different test voltages in the test mode.

11. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential and configured to maintain a predetermined voltage by passing of a current therethrough, said constant-voltage element comprising a Zener diode or a varistor;

a power source configured to form both of a secondary-transfer electric field at the secondary-transfer position and a primary-transfer electric field at the primary transfer position by applying a voltage to the transfer member a detecting portion configured to detect the current passing through the transfer member;

an executing portion configured to execute a test mode in which a test voltage is applied to the transfer member by the power source to detect the current by the detecting portion when no recording material exists at the secondary-transfer position; and a controller configured to control a voltage to be applied to the transfer member by the power source when the recording material exists at the secondary-transfer position, on the basis of the current detected by the detecting portion in the test mode, wherein the constant-voltage element maintains the predetermined voltage in the test mode.

12. An image forming apparatus according to claim 11, wherein the power source is configured to cause the current to flow from the transfer member to the constant-voltage element through the intermediary transfer member.

13. An image forming apparatus according to claim 11, wherein the voltage applied to the transfer member by the power source controlled by the controller includes a voltage lower than a voltage for forming the secondary-transfer electric field.

14. An image forming apparatus according to claim 11, wherein the executing portion executes the test mode when a region of the intermediary transfer member corresponding to a region between the recording material and a subsequent recording material in the case where images are continuously formed is in the secondary-transfer position.

15. An image forming apparatus according to claim 14, wherein the stretching members are stretching rollers having electroconductivity, and the stretching rollers are electrically connected with the constant-voltage element to electrically connect the intermediary transfer member with the constant-voltage element.

16. An image forming apparatus according to claim 11, wherein the intermediary transfer member has a structure of two layers or more, and a volume resistivity of the layer in the outer peripheral surface side is higher than a volume resistivity of the layer in an inner peripheral surface side.

17. An image forming apparatus according to claim 11, wherein the intermediary transfer member is an intermediary transfer belt, and the image forming apparatus comprises a plurality of stretching members configured to stretch the intermediary transfer belt in contact with an inner peripheral surface of the intermediary transfer belt.

18. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential, and configured to maintain a predetermined voltage by passing of a current therethrough;

a power source configured to form both of a secondary-transfer electric field at the secondary-transfer position and a primary-transfer electric field at the primary-transfer position by applying a voltage to the transfer member;

a detecting portion configured to detect the voltage applied to the transfer member;

an executing portion configured to execute a test mode in which a test current is passed through the transfer member by the power source to detect the voltage by the detecting portion when no recording material exists at the secondary-transfer position; and a controller configured to control a voltage to be applied to the transfer member by the power source when the recording material exists at the secondary-transfer position on the basis of the voltage detected by the detecting portion in the test mode, wherein the constant-voltage element maintains the predetermined voltage in the test mode.

19. An image forming apparatus according to claim 18, wherein the power source is configured to cause the current to flow from the transfer member to the constant-voltage element through the intermediary transfer member.

* * * * *